United States Patent [19]

Kinoshita et al.

[11] 3,990,894

[45] Nov. 9, 1976

[54] METHOD OF PREPARING PHOTOSENSITIVE ELEMENT FOR USE IN ELECTROPHOTOGRAPHY

[75] Inventors: Koichi Kinoshita, Narashino; Tadaji Fukuda, Tokyo, both of Japan

[73] Assignee: Katsuragawa Denki Kabushiki Kaisha, Tokyo, Japan

[22] Filed: Feb. 1, 1974

[21] Appl. No.: 438,714

Related U.S. Application Data

[60] Division of Ser. No. 310,886, Nov. 30, 1972, Pat. No. 3,849,129, which is a continuation-in-part of Ser. No. 84,354, Oct. 27, 1970, abandoned.

[30] Foreign Application Priority Data

Oct. 29, 1969 Japan ..... 44-87164

[52] U.S. Cl. ..... 96/1.5; 427/109

[51] Int. Cl.[2] ..... G03G 5/04

[58] Field of Search ..... 96/1.5, 1 R; 427/109

[56] References Cited

UNITED STATES PATENTS

| | | | |
|---|---|---|---|
| 3,355,289 | 11/1967 | Hall et al. | 96/1.5 |
| 3,489,560 | 1/1970 | Joseph | 96/1.5 |
| 3,723,105 | 3/1973 | Kitajima et al. | 96/1.5 |

FOREIGN PATENTS OR APPLICATIONS

| | | | |
|---|---|---|---|
| 1,135,460 | 12/1968 | United Kingdom | 96/1.5 |

*Primary Examiner*—David Klein
*Assistant Examiner*—John L. Goodrow
*Attorney, Agent, or Firm*—Bosworth, Sessions & McCoy

[57] ABSTRACT

In a photosensitive element including an electroconductive layer, a photoconductive layer manifesting persistent internal polarization and a highly insulative layer and utilized in the method of electrophotography wherein a first electric field is applied to deposit a charge of one polarity on the surface of the highly insulative layer, and a second field is applied to deposit a charge of the opposite polarity concurrently with the projection of a light image to form a latent image on the surface of the highly insulative layer, there is provided a vapor deposited layer at the interface between the photoconductive layer and the highly insulative layer which consists of a mixture of a first Se-Te alloy having a percentage of Te therein such that it is a highly photosensitive material and a second Se-Te alloy having a percentage of Te therein such that it has high charge trapping capability.

5 Claims, 4 Drawing Figures

METHOD OF PREPARING PHOTOSENSITIVE ELEMENT FOR USE IN ELECTROPHOTOGRAPHY

This is a division of application Ser. No. 310,886, filed Nov. 30, 1972, now U.S. Pat. No. 3,849,129 issued Nov. 19, 1974 which is a continuation-in-part of U.S. Ser. No. 84,354, filed Oct. 27, 1970, now abandoned.

BACKGROUND OF THE INVENTION

This invention relates to an improved photosensitive element for use in electrophotography and to a method of preparing such a photosensitive element.

Recently, a method of electrophotography has been developed comprising the steps of preparing a photosensitive element including a photoconductive layer having a plurality of charge trapping levels and manifesting persistent internal polarization and a highly insulative layer integrally bonded to the photoconductive layer, applying a first electric field across the photosensitive element to deposit a charge of one polarity on the surface of the highly insulative layer and applying a second electric field across the photosensitive element to deposit a charge of the opposite polarity on the surface of the highly insulative layer concurrently with the projection of a light image upon the photosensitive element, thus forming an electrostatic latent image on the surface of the highly insulative layer corresponding to the light image. This method is superior to other methods in that it is possible to use photoconductive materials of such low dark resistance that they should not be used in prior methods of electrophotography, thus providing extremely high photosensitivity. This method and photosensitive elements and materials useful in the method are fully described in U.S. Pat. Nos. 3,457,070 and 3,536,483 assigned to the assignee of the present invention.

According to this method, however, trapping of charge carriers at the interface between the highly insulative layer and the photoconductive layer or the surface layer thereof close to the highly insulative layer is utilized to form the latent image and it is necessary to use materials having a large number of charge trap levels for the photoconductive layer. Photoconductive photosensitive materials having a large number of trap levels or impurity levels generally have low photosensitivity. For this reason, it has been difficult to provide an element having both properties of efficient charge trapping and improved photosensitivity.

SUMMARY OF THE INVENTION

It is an object of this invention to provide a novel photosensitive element for use in electrophotography having a high degree of charge trapping ability and improved photosensitivity and a method of making such an element.

According to this invention, in the photosensitive element of the type referred to above and especially useful for the method of electrophotography referred to above, at least the surface portion of the photoconductive layer contiguous to the highly insulative layer is formed by simultaneously vapor depositing a first Se-Te alloy and a second Se-Te alloy wherein the first alloy contains a higher percentage of Te than the second alloy. The first alloy has a percentage of Te therein in the range of 20 to 50 mol % and serves as a highly photosensitive material. The second alloy has a percentage of Te therein in the range of 0 to 25 mol % and serves as a material of high charge trapping capability. The ratio of the first to the second alloy in the deposited layer is in the range of from 1:1 to 1:2.

DESCRIPTION OF THE PREFERRED EMBODIMENTS

Figure 1:
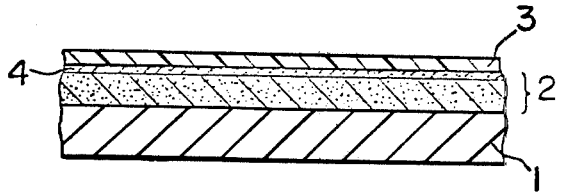
FIG. 1 shows a cross-section of a photosensitive element embodying this invention.

As shown in FIG. 1, the photosensitive element comprises an electroconductive substrate which may be a sheet of metal or paper having a certain degree of electroconductivity, a photoconductive layer 2 which may consist of any one of many well known photoconductive materials utilized in the art such as those disclosed in U.S. Pat. Nos. 3,457,070 and 3,536,483 mentioned above, a vapor deposited layer 4 according to the improvement of the present invention consisting of a first Se-Te alloy and a second Se-Te alloy and a highly insulative layer 3, all laminated in the order mentioned and bonded together into a unitary structure.

The first alloy in the layer 4 contains a higher percentage of Te than does the second alloy and is highly photosensitive while the second alloy has high charge trapping capability. The simultaneous deposition of the two alloys as described below forms an interfacial layer in which the individual characteristics of the two alloys appear to be retained rather than compromised as discussed more fully below. Several examples will illustrate the present invention.

EXAMPLE 1

A vapor deposition tank was used containing a plurality of boats which are sequentially heated. A powder of a Se-Te alloy containing 40 mol % of Te (hereinafter Se-Te 40) and serving as the highly photosensitive material and a powder of a Se-Te alloy containing 16 mol % of Te (hereinafter Se-Te 16) and serving as the material of high charge trapping capability were charged in different boats. A substrate of aluminum sheet 1 was placed in an evaporation tank and the tank was evacuated. One boat containing the highly photosensitive material and one boat containing the material of high charge trapping capability were temporarily set aside. Thereafter, a plurality of boats containing the material of high charge trapping capability were operated successively to form a homogeneously deposited layer containing a definite quantity of Te regardless of the difference in the vapor pressures of Se and Te, thus forming a layer of Se-Te 16 alloy 30 microns thick on the substrate Thereafter the remaining two boats, that is one containing the Se-Te 16 alloy containing 16 mol % of Te and the other containing the Se-Te 40 alloy containing 40 mol % of Te, were operated to simultaneously evaporate vapors of the alloys of Se-Te having different contents of Te to deposit the layer 4 containing the mixture of the highly photosensitive material and the material of high charge trapping capability upon said deposited layer of Se-Te 16 to a thickness of 1 micron.

During the vapor deposition, the deposition tank was evacuated to a pressure of $5 \times 10^{-5}$mm Hg, and the boats containing the Se-Te alloy containing 16 mol % of Te (Se-Te 16) were heated to 290° C and the boat containing Se-Te alloy containing 40 mol % of Te (Se-Te 40) was heated to 310° C. The aluminum substrate was heated to 40° to 60° C during the vapor deposition process. More particularly, a total of six boats were used, five of which were each charged with 20 g of Se-Te 16 and the remaining one with 10 g of Se-Te 40. The first boat containing Se-Te 16 was heated to 290° to evaporate the alloy. Due to the difference in the vapor pressures of Se and Te, the concentration of Te in the deposited film gradually increases with time. To compensate for this increase in the concentration of Te, before the content of of the first boat was completely evaporated the second boat containing Se-Te 16 was started. Thus, for a short interval both the first and second boats were operated concurrently, and then only the second boat was operated. In this manner, four boats containing Se-Te 16 were sequentially operated to deposit a 30 microns thick Se-Te 16 alloy layer on the aluminum substrate.

Finally, the remaining two boats, that is one containing Se-Te 16 and the other Se-Te 40, were heated to 290° and 310° C, respectively, to simultaneously evaporate their contents and form a layer having a thickness of 1 micron and containing both alloys on the layer of Se-Te 16. The ratio of Se-Te 40 to Se-Te 16 in the deposited layer was 1:2 and this ratio of the two alloys was distributed evenly through the thickness of the layer 4. Then the substrate was removed from the tank and a highly insulative layer 3 of polycarbonate was applied onto the surface of the layer 4 to a thickness of 10 microns.

A corona discharge unit was operated to deposit a charge of −2,000V on the surface of the highly insulative layer 3 and then a charge of positive polarity was deposited on the surface of the highly insulative layer concurrently with projection of a light image for 0.2 second having a brightness of 1 lux at the bright portions of the image to form a latent image on the surface of the highly insulative layer corresponding to the light image. The latent image had a potential of −100V at portions corresponding to the dark portions of the light image and a potential of +200V at portions corresponding to bright portions of the light image. The latent image could be readily developed by a charged developing powder and then transfer printed. After transfer printing, the surface of the photosensitive element was cleaned and the remaining latent image was erased in a well known manner for the next use.

Figure 2:
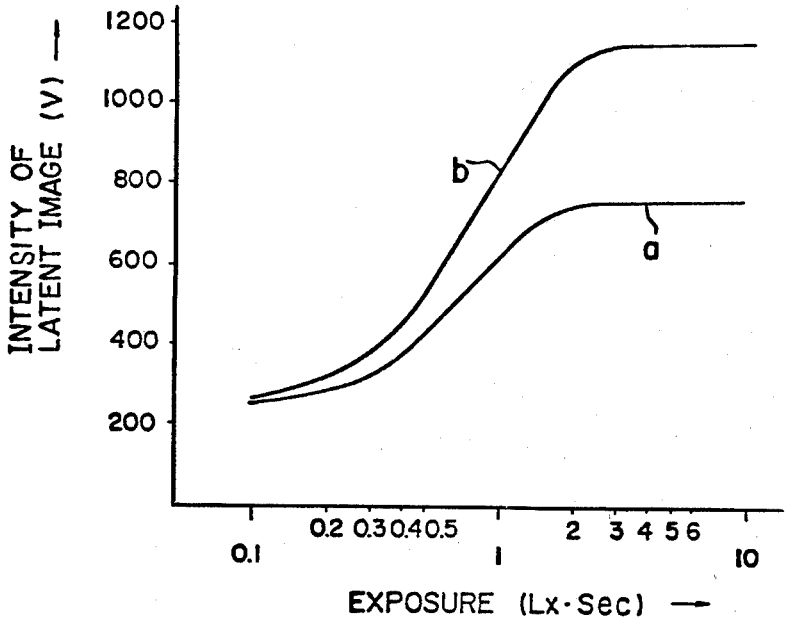
FIG. 2 is a plot showing the intensity of the latent image-versus exposure characteristics.

FIG. 2 shows the relationship between the exposure of the photosensitive element and the intensity of the latent image. From curve *a* thereof it can be seen that the intensity of the latent image reaches a maximum at a brightness of the light image of about 10 lux (for the exposure time of Example 1) and that an increase in the brightness beyond this value does not result in an increase in the intensity of the latent image.

When the layer 4 contains only Se-Te 16 alloy it is not possible to form a latent image of comparable intensity to that obtained with Example 1 unless the brightness of the light image is increased several times. On the other hand, when the photosensitive element comprises a photosensitive layer alone consisting of the Se-Te alloy containing 40 mol % of Te and not comprising the photoconductive layer of Se-Te containing 16 mol % of Te, the difference in voltages at bright and dark portions of the light image is very small and cannot be used practically. A photosensitive element including a first layer of Se-Te containing 16 mol % of Te and a second layer containing 40 mol % of Te and vapor deposited on one surface of the first layer to a thickness of 1 micron and an element including a first layer of Se-Te containing 40 mol % of Te and a second layer containing 16 mol % of Te vapor deposited on one surface of the first layer to a thickness of 1 micron produce latent images having much lower intensity than those of the first embodiment. Moreover, the sensitivity of the latter type photosensitive element is low and such an element cannot be used practically.

Although the theory involved in the phenomenon occuring in the photosensitive layer 4 consisting of the mixture of the highly photosensitive material and the material of high charge trapping capability is not yet clearly understood it may be considered as follows. Since minute particles of vapors of different photosensitive materials are concurrently deposited on the substrate to form a deposited layer of the mixture, the highly sensitive material and the material of high charge trapping capability coexist on the same plane and manifest their respective characteristics. Exchange of charge carriers between these two photosensitive materials occurs relatively easily whereby the highly photosensitive characteristic and the high charge trapping capability thereof are efficiently exhibited at the same time. The reason that a thin deposited layer of the mixture having a thickness of about one micron manifests excellent characteristics is believed to be that the photosensitive material such as Se-Te has an extremely high light absorption characteristic and absorbs nearly all light in its surface layer so that the free charge carriers excited by this light absorption readily migrate over a long distance. For this reason, it is necessary to determine the thickness of the layer 4 of the mixture according to the degree of light absorption.

It is also possible to increase the intensity of the latent image formed by facilitating the transfer of charge carriers between particles of the two different photosensitive materials in the mixture. This object can be attained by heat treatment. Example 2 illustrates this heat treatment.

EXAMPLE 2

The photosensitive element obtained by Example 1 was heat treated in the atmosphere at 65° C for 3 hours and latent images were formed with this heat treated element according to the method described in Example 1. As shown by curve *b* in FIG. 2, the intensity of the latent image was increased 1.7 times whereby increased latitude was provided to greatly improve the reproduceability of intermediate tones.

The heat treatment decreases the effect of the barrier present between particles of different photosensitive materials thus facilitating the transfer of charge carriers. Consequently, the characteristics of the particles of two different types are manifested more efficiently. It was found that the effect of the heat treatment becomes greater as the difference in the characteristics of the two photosensitive materials increases.

EXAMPLE 3

Two evaporation boats, one containing 80g of Se and the other 10g of Se-Te 40, were placed in a vapor deposition tank in the form of a belljar. After mounting a cleaned and polished aluminum substrate, 2mm thick, above the boats, the vapor deposition tank was evacuated to a vacuum of $5\times10^{-5}$ mm Hg. While the substrate was maintained at a temperature of 40° to 60° C, the temperature of the boat containing Se was elevated to 260° C to deposit a Se layer on the substrate. When the thickness of the Se layer had reached 45 microns, the temperature of the boat containing Se-Te 40 was increased to 310° C within an interval of 5 to 10 minutes, thereby increasing the thickness of the composite layer to approximately 50 microns. Thereafter, Se and Se-Te 40 were deposited concurrently to form a layer having a thickness of 1 micron and containing both Se and Se-Te 40. The ratio of Se-Te 40 to Se in the 1 micron layer was 1:1 and this ratio of materials was distributed uniformly throughout the thickness of the layer. Then the substrate was taken out of the vapor deposition tank and polycarbonate was applied onto the surface of the layer containing Se and Se-Te 40 to form a highly insulative layer having a thickness of 15 microns, thus completing a photosensitive element.

When using a Se-Te alloy containing more than 20 mol % of Te, with the above described method of evaporating the Se-Te alloy, it is difficult to form a thick layer such as 40 to 50 microns in thickness and having homogeneous composition so that in the following Example 4 the so-called flash evaporation method was used.

EXAMPLE 4

Two sets of evaporation units were mounted at the bottom of a belljar evacuated to a vacuum of $5\times10^{-5}$mm Hg, each set consisting of an evaporation boat, a reservoir for a Se-Te alloy and a belt conveyor extending therebetween. One of the reservoirs was charged with a powder (about 100 mesh) of Se-Te 20 and the other with a powder of Se-Te 40 (about 100 mesh). While an aluminum substrate, 2mm thick, was heated to a temperature of 40° to 60° C, the temperature of one boat was increased to 500° C and the powder of Se-Te 20 was charged in the boat through the belt conveyor to evaporate this Se-Te 20 alloy. During the evaporation of this alloy, the temperature of the other boat was increased to 550° C. When the thickness of the deposited layer of Se-Te 20 had reached about 50 microns, the powder of Se-Te 40 was supplied to the other boat thereby codepositing Se-Te 20 and Se-Te 40 alloys to a thickness of 0.5 micron. The ratio of Se-Te 40 to Se-Te 20 in the 0.5 micron layer was 1:2 and this ratio of the two alloys was distributed uniformly throughout the thickness of the layer. A highly insulative layer was applied in the same manner as described above in Example 3.

Figure 3:
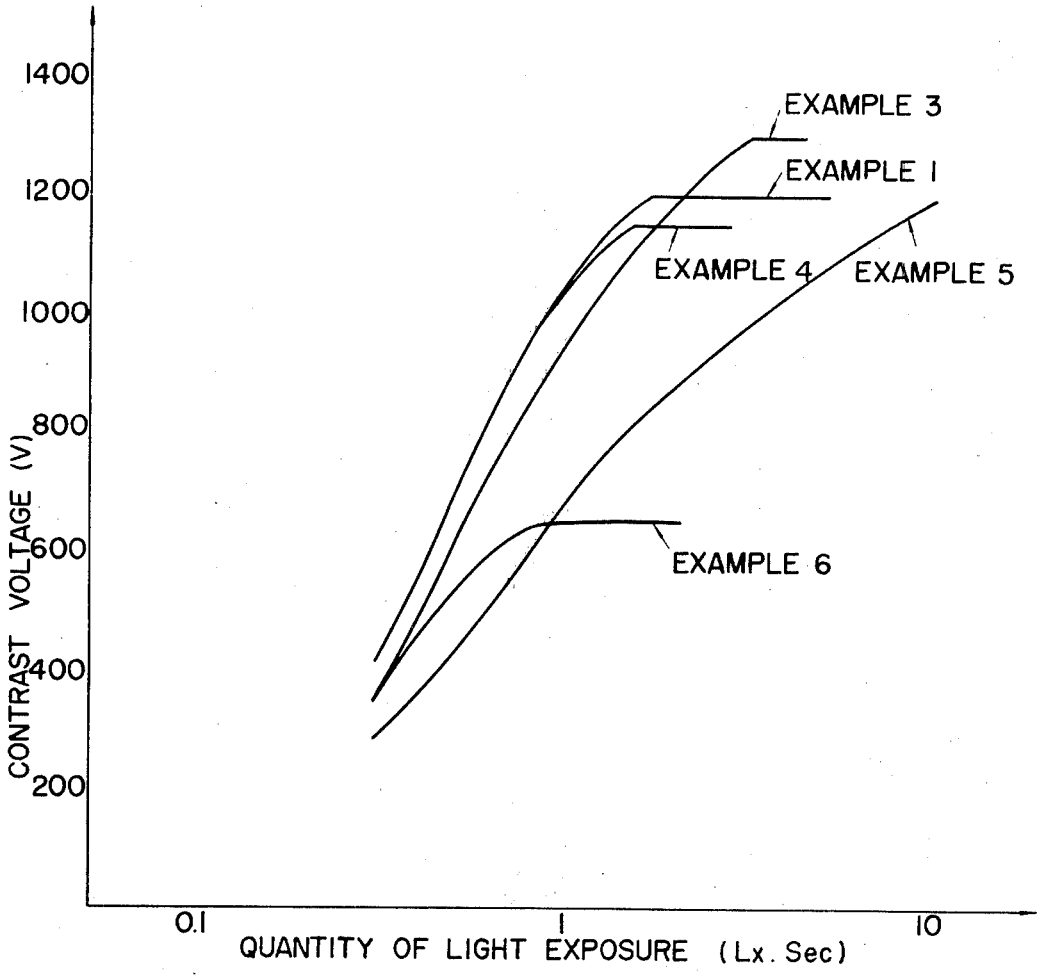
FIG. 3 is a graph showing the photosensitivity of various types of photosensitive elements.

In the above described examples, the highly photosensitive material was a Se-Te alloy containing 40 mol % of Te and the charge trapping materials were a Se-Te alloy containing 16 mol % of Te, Se alone, and a Se-Te alloy containing 20 mol % of Te. When the photosensitive elements of Examples 1, 3 and 4 were heat treated at 60° C for 2 hours, the elements of Examples 1 and 3 showed remarkable improvement in the sensitivity, but in the element of Example 4, the sensitivity did not change before and after heat treatment. However, the sensitivity of this element is sufficiently high as shown in FIG. 3. In other words, the element of Example 4 is not required to be heat treated. It was found that when the mol % of Te in the charge trapping alloy is increased beyond 25%, the photosensitivity of the element decreases.

EXAMPLE 5

In this example, a Se-Te alloy containing 30 mol % of Te was substituted for the Se-Te 40 alloy of Example 1 and a photosensitive element was prepared under the same conditions as in Example 1 except that the boat charged with the Se-Te 30 was heated to a temperature of 305° C.

EXAMPLE 6

In this example, a Se-Te alloy containing 50 mol % of Te was substituted for the Se-Te 40 alloy of Example 1 and a photosensitive element was prepared under the same conditions as in Example 1 except that the boat charged with the Se-Te 50 was heated to a temperature of 320° C.

FIG. 3 shows the sensitivity curves of the photosensitive elements of Examples 1 and 3 to 6 in terms of the contrast voltage or intensity of latent image formed. While the sensitivity of the photosensitive element of Example 5 was improved greatly by the heat treatment, that of Example 6 decreased. For this reason, the sensitivity of Example 6 shown in FIG. 3 represents that before heat treatment.

To demonstrate the advantage of providing a codeposited layer consisting of highly photosensitive material and charge trapping material between the highly insulative layer and the photoconductive layer, the following examples are illustrated for comparison with the foregoing examples.

EXAMPLE 7

In Example 1 wherein first to fifth boats containing Se-Te 16 and a sixth boat containing Se-Te 40 were used, after forming the layer of Se-Te 16 by using the first to fourth boats, the sixth boat containing Se-Te 40 was operated to form a layer of Se-Te 40 alone. The same conditions of vapor deposition were used. The photosensitive element prepared in this manner is designated by (B) in FIG. 4 whereas that of Example 1 is designated by (A).

EXAMPLE 8

Figure 4:
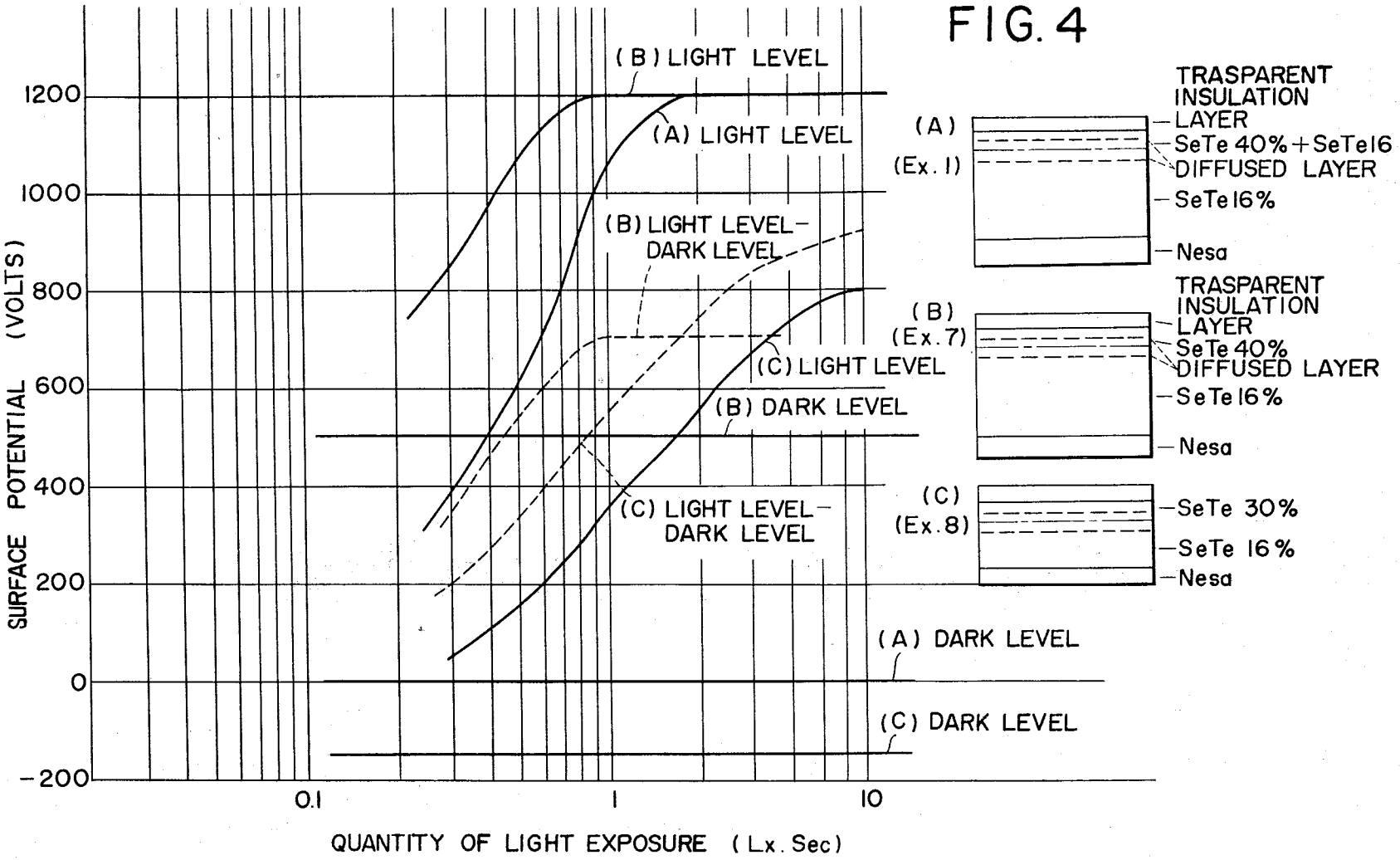
FIG. 4 is a graph showing light and dark surface potential characteristics of three types of photosensitive elements.

Another photosensitive element which is designated by (C) in FIG. 4 was prepared in the same manner as in Example 5 except that the sixth boat which was charged with a Se-Te alloy containing 30 mol % of Te was operated alone to form a layer consisting only of Se-Te 30.

As shown in FIG. 4, the sensitivity of element A (Example 1) is represented by a solid line curve "(A) light level" since curve "A dark level" is on the zero level. The sensitivity of element B (Example 7) is shown by a dotted line curve "(B) light level — dark level" whereas that of C (Example 8) is shown by a dotted line curve "(C) light level — dark level". All characteristics were obtained under the same image forming conditions employing a corona discharge. As mentioned above, Examples 7 and 8 are control examples.

As can be noted from FIG. 4, in element B, since the trap property of the charge carriers is poor, in the method of electrophotography described above a substantial number of charge carriers flows during the dark state at the second step of field application, so that the level of the trapped charge carriers will shift toward the electrode to which the second field is applied. On the other hand, element A is greatly different from element B in the dark level. It is thought that due to coexistence of the Se-Te alloys respectively containing 16 mol % of Te and 40 mol % of Te, carrier or charge trap levels are formed throughout the codeposited layer, thereby decreasing the quantity of carriers that flow when the second field of the opposite polarity is applied.

Further, in a single alloy layer, elements such as element C (Example 8) and element B (Example 7), the composition of the vapor deposited layer of the Se-Te alloy is uniform throughout the thickness of the layer whereas in the codeposited layer of element A (Example 1), by adjusting the time and rate of vapor deposition of the two different Se-Te alloys it is possible to gradually vary the ratio of the two alloys, and of their respective characteristics, in the direction of thickness of the layer as indicated by the "diffused layer" in FIG. 4.

In addition to those described hereinabove, we have also prepared a number of photosensitive elements wherein the Te concentration of the Se-Te alloy comprising the charge trapping component was varied from 0 to 25 mol % while maintaining Te concentration of the Se-Te alloy constituting the high sensitivity component of the layer 4 at a constant value of 40 mol % and found that they have comparable characteristics.

We have also investigated the characteristics of photosensitive elements wherein the Te concentration of the Se-Te alloy constituting the high sensitivity component of the layer 4 was varied from 20 to 50 mol % and found that the sensitivity increases with the Te concentration but the S/N ratio decreases when the Te concentration was increased beyond 50 mol %. From this it can be said that a Se-Te alloy containing about 40 mol % of Te is suitable for the photosensitive layer.

What is claimed is:

1. A method of manufacturing a photosensitive element for use in the method of electrophotography wherein a first electric field is applied across a photosensitive element comprising an electroconductive layer, a photosensitive photoconductive layer manifesting persistent internal polarization and a highly insulative layer integrally bonded to said photosensitive photoconductive layer to deposit a charge of one polarity on the surface of said highly insulative layer, and a second electric field is applied across said photosensitive element to deposit a charge of the opposite polarity on the surface of said highly insulative layer concurrently with the projection of a light image upon said photosensitive element whereby to form a latent image on the surface of said highly insulative layer corresponding to said light image, said method comprising the steps of vapor depositing a photosensitive photoconductive material upon said electroconductive layer to form said photosensitive photoconductive layer, selecting a first Se-Te alloy having a percentage of Te therein in the range of 20 to 50 mol % and serving as a photosensitive material, selecting a second Se-Te alloy having a percentage of Te therein in the range of 0 to 25 mol % and serving as a charge trapping material, selecting said first and second alloys so that said first alloy contains a higher percentage of Te than said second alloy, simultaneously vapor depositing said first and second alloys upon said photosensitive photoconductive layer to form an interfacial layer, controlling the amounts of said alloys deposited such that the ratio of said first alloy to said second alloy in said interfacial layer is in the range of from 1:1 to 1:2 and applying said highly insulative layer onto said interfacial layer.

2. A method according to claim 1 wherein said first alloy is vapor deposited upon said photosensitive photoconductive layer prior to the simultaneous vapor deposition of said first and second alloys.

3. A method according to claim 1 wherein said first alloy is loaded in a first evaporation boat, said second alloy is loaded in a second evaporation boat, said first evaporation boat is firstly operated to vapor deposit said first alloy and then said first and second boats are operated simultaneously to codeposit said first and second alloys.

4. A method according to claim 3 wherein said first and second alloys are vapor deposited by the flash evaporation method in which each alloy is contained in a reservoir and supplied therefrom to a boat heated to the evaporation temperature of the respective alloy.

5. A method of manufacturing a photosensitive element for use in electrophotography comprising the steps of selecting a first Se-Te alloy having a percentage of Te therein in the range of 20 to 50 mol %, selecting a second Se-Te alloy having a percentage of Te therein in the range of 0 to 25 mol %, selecting said first and second alloys so that said first alloy contains a higher percentage of Te than said second alloy, vapor depositing said second alloy upon an electroconductive substrate to form a photosensitive photoconductive layer, simultaneously vapor depositing said first and second alloys upon said photosensitive photoconductive layer to form an interfacial layer, controlling the amounts of said alloys deposited such that the ratio of said first to said second alloy in said interfacial layer is in the range of from 1:1 to 1:2, and applying a highly insulative layer onto said interfacial layer.

* * * * *

UNITED STATES PATENT AND TRADEMARK OFFICE

CERTIFICATE OF CORRECTION

PATENT NO. : 3,990,894

DATED : November 9, 1976

INVENTOR(S) : Koichi Kinoshita and Tadaji Fukuda

It is certified that error appears in the above-identified patent and that said Letters Patent are hereby corrected as shown below:

Column 2, line 61, after "substrate" insert --1.--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*